US009057209B2

(12) United States Patent
Eichenstein

(10) Patent No.: US 9,057,209 B2
(45) Date of Patent: Jun. 16, 2015

(54) LOW-COST DOOR KEY WITH SWITCH SENSOR INDICATOR TO DETECT DEAD BOLT LOCK STATUS

(71) Applicant: Joseph Eichenstein, Lakewood, NJ (US)

(72) Inventor: Joseph Eichenstein, Lakewood, NJ (US)

( * ) Notice: Subject to any disclaimer, the term of this patent is extended or adjusted under 35 U.S.C. 154(b) by 116 days.

(21) Appl. No.: 13/662,866

(22) Filed: Oct. 29, 2012

(65) Prior Publication Data

US 2013/0145802 A1 Jun. 13, 2013

Related U.S. Application Data

(60) Provisional application No. 61/628,341, filed on Oct. 28, 2011.

(51) Int. Cl.
*E05B 41/00* (2006.01)
*E05B 19/22* (2006.01)

(52) U.S. Cl.
CPC ..... *E05B 41/00* (2013.01); *E05B 19/22* (2013.01)

(58) Field of Classification Search
CPC ..... E05B 19/22; E05B 41/00
USPC ..... 340/1, 539.1, 539.23, 540, 5.7; 70/395, 70/408, 432
See application file for complete search history.

(56) References Cited

U.S. PATENT DOCUMENTS 4,124,847 A 11/1978 Cashman
4,490,999 A 1/1985 Castle et al.
4,631,943 A * 12/1986 Hoener ..... 70/395
4,712,396 A 12/1987 Cary et al.
5,025,426 A * 6/1991 Blumberg et al. ..... 368/10
5,111,007 A 5/1992 Miller et al.
5,435,160 A * 7/1995 Linsalato et al. ..... 70/408
5,461,360 A 10/1995 Guim et al.
5,565,843 A 10/1996 Meyvis
5,595,080 A 1/1997 Whinton
5,608,378 A 3/1997 McLean et al.
5,898,365 A 4/1999 Niederlein
6,093,980 A 7/2000 Yamamoto et al.
6,166,634 A 12/2000 Dean
6,246,019 B1 * 6/2001 Nakamura et al. ..... 200/6 A
6,255,957 B1 7/2001 Sonderegger et al.
6,441,735 B1 8/2002 Marko et al.
6,575,005 B1 6/2003 Hunter
6,703,919 B2 3/2004 Baset
6,845,567 B1 1/2005 Muncy
6,848,729 B2 2/2005 Caspi et al.

(Continued)

FOREIGN PATENT DOCUMENTS

DE 202004017289 U1 3/2005
JP 5263556 A2 10/1993

(Continued)

*Primary Examiner* — Benjamin C Lee
*Assistant Examiner* — Chico A Foxx
(74) *Attorney, Agent, or Firm* — Alfred M Walker

(57) ABSTRACT

A low-cost switch sensor remote dead bolt status indicator includes a switch sensor within a key body of a door key which starts a sensor at a door lock location upon sensing of a dead bolt entering into a locked position. The sensor is provided with a self shut-off feature operating after a fixed duration of minutes length has elapsed. The indicator also includes a receiver in the hand held key, which is capable of receiving signals from the sensor after the user presses an inquiry button on its surface. The hand held key has two indicators for alternately displaying the lock's dead bolt status as being locked or unlocked.

9 Claims, 1 Drawing Sheet

(56) References Cited

U.S. PATENT DOCUMENTS

| | | | | |
|---|---|---|---|---|
| 6,959,568 | B2 | 11/2005 | Abeler | |
| 6,963,280 | B2 | 11/2005 | Eskildsen | |
| 7,196,623 | B1 | 3/2007 | Wang | |
| 7,450,012 | B2 | 11/2008 | Harmon | |
| 7,498,936 | B2 | 3/2009 | Maeng | |
| 7,832,238 | B2 | 11/2010 | Misner et al. | |
| 7,866,195 | B2 | 1/2011 | Levine | |
| 7,898,382 | B2 | 3/2011 | Berstis et al. | |
| 2004/0080403 | A1 | 4/2004 | Eshel | |
| 2004/0103702 | A1* | 6/2004 | Abeler | 70/408 |
| 2007/0262848 | A1 | 11/2007 | Hicks | |
| 2008/0008313 | A1* | 1/2008 | Fyke | 379/433.01 |
| 2008/0136585 | A1* | 6/2008 | Eskildsen et al. | 340/5.7 |
| 2009/0064746 | A1* | 3/2009 | Bigdely Shamlo | 70/432 |
| 2009/0178450 | A1 | 7/2009 | Schensky | |
| 2009/0201151 | A1* | 8/2009 | De Levie et al. | 340/540 |
| 2012/0207265 | A1* | 8/2012 | Weinstein | 377/15 |

FOREIGN PATENT DOCUMENTS

| | | | |
|---|---|---|---|
| JP | 2006200154 | A | 3/2006 |
| KR | 100301641 | B1 | 11/2001 |
| KR | 100668398 | B1 | 1/2007 |

* cited by examiner

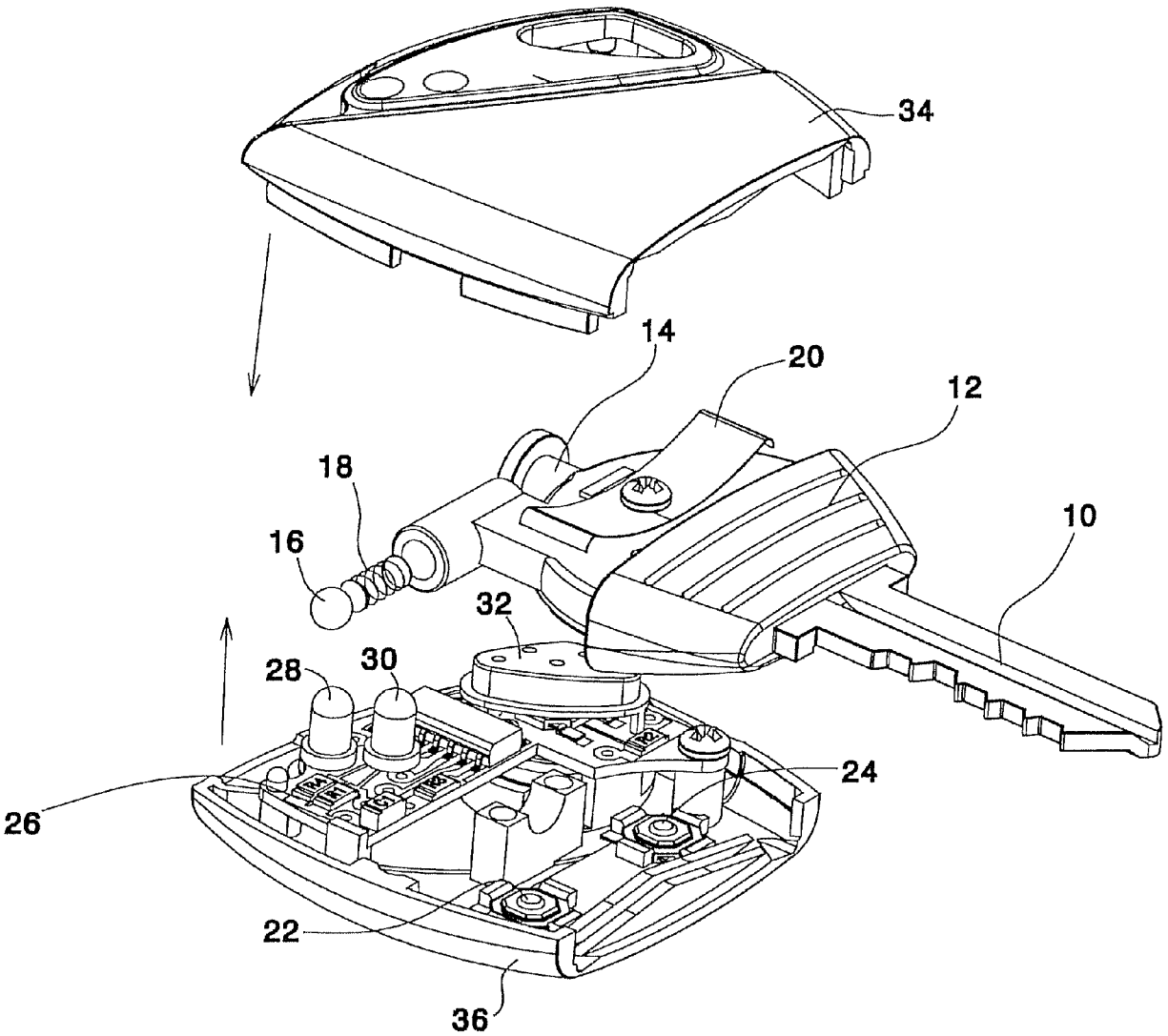
34
10
12
20
14
18
16
32
30
28
24
22
36
26

LOW-COST DOOR KEY WITH SWITCH SENSOR INDICATOR TO DETECT DEAD BOLT LOCK STATUS

RELATED APPLICATIONS

This application claims benefit and priority of provisional application Ser. No. 61/628,341 filed on Oct. 28, 2011 under 35 U.S.C. §119(e), which application is incorporated by reference herein.

FIELD OF THE INVENTION

The present invention relates to low cost remote reminders whether a dead bolt lock of a building door is locked or unlocked.

BACKGROUND OF THE INVENTION

People often leave their house and wonder whether they locked the dead bolt of their front door. Typically they would have to get out of their car and return to the house and check to see if the door is bolted. While remote status checking devices using radio communications links are known, a simple low cost device is needed.

OBJECTS OF THE INVENTION

It is an object of the present invention to provide a low-cost switch sensor remote dead bolt status indicator.

It is also an object of the present invention to provide a door lock indicator which is built into the door lock key head.

It is also an object of the present invention to provide a door key with a sensor which senses the instant that a dead bolt is locked.

It is also an object of the present invention to improve over the disadvantages of the prior art.

SUMMARY OF THE INVENTION

In keeping with these objects and others which may become apparent, this invention is a door lock key with a low-cost system using a sensor to detect the presence of a dead bolt in a locked position, whereby the door to secured is assuredly locked/secured.

A very small hand-held indicator, such as in the handle head of the door lock key powered by a button cell, contains a sensor to detect whether the door is locked or unlocked.

In an alternate embodiment, the present invention includes an adapter which can be retrofit to an existing door key, so that it has the ability to sense whether a door is locked or unlocked and communicate that information to the person holding the key.

A major feature of this invention is the ease of installation of the unit within the key head of the actual key, with the sensor usable by a customer with average skills and minimal tools. In fact, the only tool necessary is the key itself. Beyond low first cost, low cost operation in terms of long battery life is also a feature of this invention.

No radio frequencies are needed, and no remote key fob is needed to obtain signals that a door is locked or unlocked. The low-cost features inherent to the design of this invention first relate to the communications concept and operation. At the door that is secured, the sensor is activated. This is different than complex prior art transceivers which need transmissions in both directions or have a receiver that is always "on", and which may be capable of performing tasks other than visual indicator status, such as locking an unlocked door from a remote position. Those features are not within the scope of the present invention.

The operation which supports the use of such a spartan system is as follows:

The switch sensor is located at the door being monitored and configured to detect an open position and a closed position of a deadbolt by which the door is secured. Upon detection of the dead bolt in the locked position, the sensor immediately indicates in the key head itself whether the door is locked or unlocked.

If a key sensor is activated by movement of the key within the lock, a signal is generated, such as a visual or other sensory perceptible indicator, such as a colored LED indicator, indicating that the dead bolt is in its locked position. Other visual or vibratory indicators may be used.

However, if the key is not utilized to lock the door, the key will not have the visual indicator, or it may have an indicator that indicates that the key was not used to lock the door and the sensor in the key decides that the deadbolt is not in its locked position. A signal is then generated to activate a visual or other sensory perceptible indicator, such as a different colored LED, which will indicate that the person has forgotten to operate the dead bolt.

Other features that are related to low cost include the switch sensor assembly. This preferably includes a few easily assembled components, such as molded plastic parts affording easy custom adjustment for most installations with a low cost switch, such as, for example, a momentary single pole, single throw SPST switch which can be a membrane switch of the type used on a telephone or calculator. Other types of switch sensors, such as magnetic, optical, ultrasonic or motion sensors and the like, can be used, as are known to those skilled in the art.

The service life of the key sensor battery is very long since the sensor and indicator LED's are only operated to activate the sensor The key unit is configured for easy replacement of the battery cell therein.

The general instructions to operate the key locking indicator are the following steps:

1. Insert the key into the lock.
2. Turn the key to the opening or closing.
3. After turning the key left or right, the appropriate LED lights up.
4. Left or right rotation action light a different LED from what light before.
5. While turning the key left or right for the first 12 seconds, the light of the LED will stay unchangeable (even if the user is playing with the key) in order to indicate the exact status of the lock. After removing the key from the keyhole and pressing the indicator button, the suitable LED indicator lights up. Memory running the LED is kept until the insertion of the key inside the keyhole again and its rotation.

For example, the key indicator includes a key (10) which is inserted into the key body, which itself is inserted between the bottom plastic covers and the top plastic cover. While closing or opening the key and the key body rotate together around the axis, with the direction of rotation inside the upper and lower plastic parts. During rotation of key body, the spring is compressed while a spherical sphere enters into the key body with leaf springs being also compressed on one side. Continuing rotation of the key body is pressed, so that one of the buttons according to the direction of rotation of the key.

The buttons represent the direction of rotation of the key indicating (opening/closing) If the button is pressed then the green LED lights up (indicating a closing mode). If the button is pressed, then the red LED lights up (indicating an open mode). When one of the buttons is pressed, a timer inside the electronic circuit will be activated, so that the timer keeps in memory the direction of rotation, according to the button pressed, then the timer deactivates the opposite button for a few seconds. For example; in the first case button is pressed and in the next following 10 seconds the other button is also pressed, the information stored in the memory device will still be as if the first button is pressed.

After removing the door key, the user can click another button that will light the LED that represents the direction of rotation.

BRIEF DESCRIPTION OF THE DRAWINGS

The present invention can best be understood in connection with the accompanying drawings. It is noted that the invention is not limited to the precise embodiments shown in drawings, in which:

FIG. 1 is an exploded perspective view of the key indicator of the present invention.

DETAILED DESCRIPTION OF THE INVENTION

The following is a detailed description of example embodiments of the invention depicted in the accompanying drawings. The example embodiments are in such detail as to clearly communicate the invention. However, the amount of detail offered is not intended to limit the anticipated variations of embodiments; on the contrary, the intention is to cover all modifications, equivalents, and alternatives falling within the spirit and scope of the present invention, as defined by the appended claims. The descriptions below are designed to make such embodiments obvious to a person of ordinary skill in the art.

A low-cost switch sensor remote dead bolt status indicator includes a sensor which starts a transmitter at a door lock location upon sensing of a dead bolt being in a locked position. Optionally, the indicator is provided with a self shut-off feature operating after a fixed duration of minutes length has elapsed. The indicator also includes circuitry in a hand held unit, such as a key with a sensor embedded therein, capable of receiving signals from the sensor after the user presses an inquiry button on its surface. The hand held key has two indicators for alternately displaying the lock's dead bolt status as being locked or unlocked. In an alternate embodiment, the switch sensor is provided to indicate elapsed time status.

As shown in FIG. 1, the key indicator is a key which is used to both lock a deadbolt lock and to store an indicator whether the door is locked or not.

Key (10) is inserted into the key body (12), where the key body (12) is inserted between the bottom plastic covers (36) and the top plastic cover (34).

While closing or opening the key (10), the key body (12) is rotating together around an axis (14) with the direction of rotation inside the upper and lower plastic parts (34, 36). During rotation of key body (12) spring (18) is compressed while the spherical body (16) enters into the key body (12), and leaf springs (20) are also compressed on one side. Continuing rotation of key body (12), presses one of the buttons (22, 24) according to the direction of rotation of the key.

Buttons (22, 24) represent the direction of rotation of the key (10) (i.e. opening/closing) If button (24) is pressed then the green LED (28) lights up (indicating closing mode) If button (22) is pressed, then the red LED (30) lights up (indicating open mode). When one of the buttons (22, 24) is pressed, a timer inside the electronic circuit will be activated (26), the timer keeps in memory the direction of rotation, according to the button pressed, and the timer deactivates the opposite button for a few seconds. For example; incase button (22) is pressed and in the next following 10 seconds button (24) is also pressed, the information stored in the memory device will still be as if button (22) is pressed. After removing the door key the user can click a button (32) that will light the LED that represents the direction of rotation.

The method of use involves the following steps:

1. Insert the key (10) into the lock.
2. Turn the key (10) to the opening or closing mode.
3. After turning the key (10) left or right, the appropriate LED (28 or 30) lights up.
4. Left or right rotation action light a different LED (28 or 30) from what was lit before.
5. While turning the key (10) left or right for the first 12 seconds, the light of the LED (28 or 30) will stay unchangeable (even if the user is playing with the key (10)) in order to indicate the exact status of the lock. After removing the key (10) from the keyhole and pressing the indicator button (22 or 24), the suitable LED (28 or 30) indicator lights are lit up. Memory running the LED (28 or 30) is kept until the insertion of the key (10) inside the keyhole again and its subsequent rotation.

A ball (16) and spring (18) is used to stabilize the mechanical mechanism in order to prevent pressing switches (22) and (24) coincidentally by accident.

The DC battery is located inside the plastic key body (12), and the buttons (22) and (24) are the switches. The semi-circular yoke with no number is the bearing for the axis (14).

In order to retrofit an existing conventional key (10) into the key body (12), there is a need for a screw and screw driver to connect the key (10) to the key body (12).

Key (10) uses a low voltage power source, such as, for example, a button cell for power. User input is preferably achieved by momentary push button switch (22 or 24), which serves the "inquiry" function powering to energize either green LED (28) if a signal had been detected or alternatively red LED (30) if no signal had been detected. Key (10) would benefit from being a single chip integrated circuit due to the reduced space within key body (12) of key (10). Other display options besides LED's are available including liquid crystal geometric or alpha types. Other low voltage power sources include photovoltaic cells.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

I claim:

1. A key-mounted status indicator for a lock, comprising:

a key body housing carrying:

a low voltage power source;

a memory;

a pair of sensor switch buttons;

an externally mounted inquiry button; and an externally visible pair of sensory indicators;

a hand held door key having a keyed portion and a gripping portion, the key having an attached key body over the gripping portion;

the key body nesting within the key body housing, and comprises a mounted leaf spring, an actuating plate, a spring resisting a spherical body, and a recess;

wherein as the key body housing is rotated to turn the key around an axis inside the lock during a locking action or an unlocking action, said key body rotates in the direction of rotation around said axis, said spring is compressed while the spherical body enters into said recess of the key body, and the leaf spring is compressed on the side in the direction of rotation to create relative rotation between the key body and the key body housing, wherein further continuing relative rotation causes the actuating plate to press a respective one of said sensor switch buttons according to the corresponding direction of rotation to store respective rotational direction information indicative of a corresponding locked/unlocked status in said memory;

said pair of sensory indicators indicating locked/unlocked status stored in said memory upon pressing of the inquiry.

2. The key-mounted status indicator as in claim 1 wherein each of said pair of sensory indicators, is a light.

3. The key-mounted status indicator as in claim 1 wherein each of said pair of sensory indicators, is an LED.

4. The key-mounted status indicator as in claim 1, further comprises a vibrator sensory indicator to provide the locked/unlocked status to the user.

5. The key-mounted status indicator as in claim 1 wherein the said key body includes an open ended pocket into which said hand held door key is inserted.

6. The key-mounted status indicator as in claim 1 wherein said low voltage power source is a low voltage battery.

7. The key-mounted status indicator as in claim 1 wherein said low voltage power source is a button battery.

8. The key-mounted status indicator as in claim 1 wherein said low voltage power source is photovoltaic.

9. The key-mounted status indicator as in claim 1 further comprising a self shut-off component operating to shut off the indicators after a fixed duration from activation.

* * * * *